US007333877B2

(12) United States Patent
Dabrowa et al.

(10) Patent No.: US 7,333,877 B2
(45) Date of Patent: Feb. 19, 2008

(54) SYSTEM AND METHOD OF PRODUCING MULTI-COLORED CARPETS

(75) Inventors: Paul M. Dabrowa, Rocky Face, GA (US); Charlie Thompson, Cohutta, GA (US); Dina Poindexter, Ringgold, GA (US); Katrina Kuhels, Cleveland, TN (US); Ashlee Swift, Dalton, GA (US)

(73) Assignee: Mohawk Carpet Corp., Calhoun, GA (US)

( * ) Notice: Subject to any disclaimer, the term of this patent is extended or adjusted under 35 U.S.C. 154(b) by 20 days.

(21) Appl. No.: 11/375,185

(22) Filed: Mar. 14, 2006

(65) Prior Publication Data

US 2006/0149409 A1 Jul. 6, 2006

Related U.S. Application Data

(63) Continuation of application No. 10/789,945, filed on Feb. 27, 2004, now Pat. No. 7,130,711.

(51) Int. Cl.
*D05C 15/26* (2006.01)

(52) U.S. Cl. ..... 700/138; 112/475.23

(58) Field of Classification Search ..... 112/102.5, 112/410, 2.2, 80.01, 470.01, 475.23, 80.23; 700/136, 138, 131
See application file for complete search history.

(56) References Cited

U.S. PATENT DOCUMENTS

| | | | | |
|---|---|---|---|---|
| 3,875,883 | A | 4/1975 | Eberwein et al. | |
| 5,058,518 | A | 10/1991 | Card et al. | |
| 6,877,449 | B2 * | 4/2005 | Morgante et al. | 112/475.23 |
| 6,945,183 | B2 * | 9/2005 | Card et al. | 112/80.23 |
| 7,096,806 | B2 * | 8/2006 | Card et al. | 112/80.73 |
| 7,130,711 | B2 | 10/2006 | Dabrowa et al. | |

* cited by examiner

*Primary Examiner*—Danny Worrell
(74) *Attorney, Agent, or Firm*—Ryan A. Schneider, Esq.; Troutman Sanders LLP

(57) ABSTRACT

A system and method for producing multi-colored carpets using a tufting machine. The present invention features a system and method for: providing a multi-colored pattern which is analyzed for validity with reference to a particular tufting machine; collecting parameters concerning a particular tufting machine; determining the colors of yarn to load with each needle of the particular tufting machine; and generating a report including a palette of colors used within the pattern, a chart indicating which color of yarns are used within each needle position, and a summary of the number of yarn cones needed to create a carpet of a predetermined size with the particular tufting machine.

19 Claims, 15 Drawing Sheets
(3 of 15 Drawing Sheet(s) Filed in Color)

SYSTEM AND METHOD OF PRODUCING MULTI-COLORED CARPETS

CROSS REFERENCE TO RELATED APPLICATIONS

This patent application is a continuation of U.S. patent application Ser. No. 10/789,945, filed 27 Feb. 2004, now U.S. Pat. No. 7,130,711 and entitled "System and Method of Producing Multi-Colored Carpets," the entirety of which is hereby incorporated by reference.

FIELD OF THE INVENTION

The present invention relates generally to methods of manufacture of carpets and, more specifically, to methods of producing multi-colored carpets more efficiently using a tufting machine.

BACKGROUND OF THE INVENTION

The manufacturing of carpet products through use of a tufting machine differs from other carpet making methods, because tufting machines insert loops of yarn into a backing of fabric or other medium. The backing provides the retentive pressure necessary to hold the loops of yarn in place, while an adhesive is applied to the backing once the carpet has been completed. Tufting machines generally comprise high-speed machines with multiple needles lined side-by-side that insert the loops of yarn into the backing material. The distance between the tufting needles is generally referred to as the gauge rate, and corresponds to the density of the carpet face. The tufting needles typically perform a reciprocating motion as the tufting machine shifts the needles back and forth as the backing is fed through the machine. For example, a particular needle may only tuft a two-inch wide section or column of the carpet, because the needle is shifted back and forth within the two-inch area. In more specialized tufting machines, needle holders may be selectively latched to a reciprocating latch bar so that needles may be individually selected for the tufting process. Consequently, only selected needles would be subject to the tufting process.

Tufting machines also provide the functionality to introduce a plurality of colors, which allow for the formation of simple carpet patterns similar to those found in woven carpets. Due to operating characteristics, tufting machines are generally limited to tufting carpets which utilize only six distinct colors. Generally, each needle of the tufting machine is associated with six creels. Each creel comprises a large frame used to support yarn cones, wherein the yarn is directly fed to the corresponding needle of the tufting machine. Accordingly, each needle of the tufting machine may be capable of tufting six different colors of yarn. Therefore, to ensure that the tufting machine can implement the pattern, carpet designers generally do not entertain patterns comprising more than six colors. Further, tufting machines are generally twelve to fifteen feet in width and comprise ninety-six needles capable of tufting over 250 feet of carpet and, therefore, are inherently difficult to anticipate during pattern design.

Also, the six color per needle limitation impinges on the overall utilization of the tufting machine. In order to ensure that a carpet will be continuously tufted without encountering a stoppage of the machine due to improper loading of a color, the same six colors are typically loaded on each creel.

A creel is basically a spindle which carries the yarn for each needle. Each needle is adapted to receive six colors (one from each creel).

The process of mounting yarn cones on the yarn holder of the creel (also referred to as "creeling") typically requires the tufting machine operator to load the six colors of the pattern onto the six creels associated with each needle of the tufting machine. This is true even though a particular needle of the tufting machine may not require all six colors for the section or column of carpet that the needle tufts. Such a process of mounting yarn cones may result in significant amounts of yarn waste, because not all of the yarn colors will be used by each needle of the tufting machine. Additionally, such a process of mounting yarn cones may result in yarn damage, because unnecessary handling of the yarn may cause the yarn to fray or unravel. Further, the "creeling" process indirectly limits pattern design. Even if a carpet designer created a pattern with more than six colors that could be implemented on a tufting machine, the tufting machine operator would not necessarily know how to load the appropriate colors onto the creels of each needle of the tufting machine. Manually determining which colors to associate with each needle of the tufting machine based on a given pattern is potentially more difficult than the actual designing of the pattern.

The problem with the limited availability of only six colors per carpet is that it limits the overall aesthetic appearance of the carpet. Basically, it is customary for consumers to desire ornate and aesthetically pleasing carpets which utilize significantly more than six colors, such as flower or animal patterns which require extensive colorization. Such designs are typically unavailable when limited to only six colors.

Accordingly, there is a need in the art for a system and method of analyzing a pattern that automatically determines the appropriate palette of colors used within the pattern.

There is also a need in the art for a system and method of analyzing a pattern that automatically determines the validity of a pattern in association with a predetermined tufting machine.

Further, there is a need in the art for a system and method of analyzing a pattern that automatically determines the number of yarn cones necessary to implement the pattern on a tufting machine.

Additionally, there is a need in the art for a system and method of analyzing a pattern that automatically determines the amount of yarn for each color to be used with each needle of a tufting machine and how the yarn should be loaded onto the tufting machine based on needle position.

SUMMARY OF THE INVENTION

Broadly described, the present invention comprises a system and method for producing multi-colored carpets using a tufting machine. More particularly, the present invention features a system and method for: providing a multi-colored pattern which is analyzed for validity with reference to a particular tufting machine; collecting parameters concerning a particular tufting machine; determining the colors of yarn to load with each needle of the particular tufting machine; and generating a report including a palette of colors used within the pattern, a chart indicating which color of yarns are used within each needle position, and a summary of the number of yarn cones needed to create a carpet of a predetermined size with the particular tufting machine.

Other features and advantages of the present invention will become apparent upon reading and understanding the present specification when taken in conjunction with the appended drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1A:
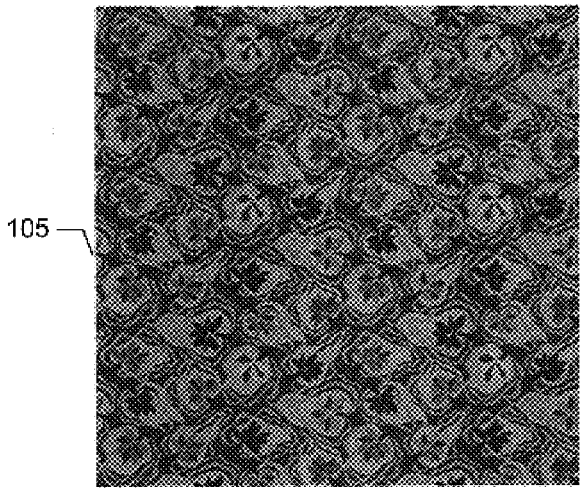
FIGS. 1A-1B display a diagram of a pattern and portions of a pattern in accordance with an exemplary embodiment of the present invention.
Figure 1B:
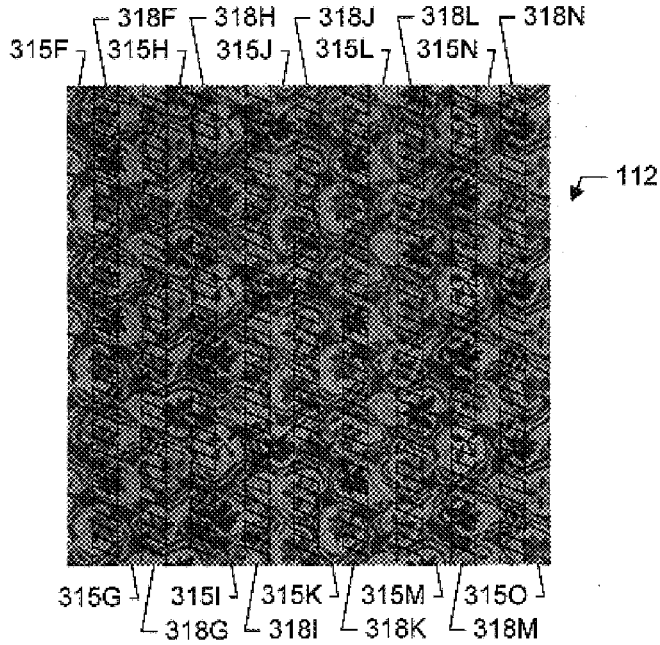

Referring now to the drawings, in which like numerals refer to like parts throughout the several views, FIGS. 1A-1B display a diagram of a pattern 105 and portions 112 of a pattern 105 in accordance with an exemplary embodiment of the present invention.

Prior to the present invention, patterns for tufted carpets, tapestries, wall-hangings, and other appropriate tufted products were limited to six colors. Designs of more complicated color schemes were either impossible to achieve or too costly to produce. Multi-colored designs were often reduced to six colors, resulting in the loss of the design's aesthetic appearance. For example, a consumer desiring to have three humming birds produced on a tapestry may have been limited to three humming birds of the same color, rather than three humming birds of different, more appealing, colors. To accommodate more complicated and desirable designs, the present invention may automatically validate a multi-colored pattern for a particular tufting machine. If the provided pattern is valid, the present invention may also provide guidance to tufting machine operators in loading yarn colors for more intricate pattern designs.

In a preferred embodiment of the present invention, the pattern 105 is digital image data comprising pixels that may be examined for color determination. The digital image data may be processed by a processing unit 512 and stored on a memory device 514, 516. Unless specified otherwise, all further references herein to a pattern 105 refer to a digitized pattern 105 comprising digital image data. Also, pattern 105 as illustrated in FIGS. 1A-1B is for exemplary purposes only. One skilled in the art will recognize that other valid patterns exist within the scope of the present invention. Accordingly, the present invention is not limited to the pattern 105 illustrated in FIGS. 1A-1B.

In an exemplary embodiment of the present invention, the validation of a pattern 105 requires examining the portion of the pattern 105 that corresponds to the section or column of product that each needle will tuft, to determine if more than the predetermined number of colors is used. Accordingly, validating a pattern 105 requires obtaining machine data of a particular tufting machine on which the pattern 105 will be implemented. For the purposes of pattern validation, relevant machine data may include the number of needles of the tufting machine, the number of creels associated with each needle, the gauge of the needles of the tufting machine, and the width of carpet that each needle tufts.

The operational characteristics of the tufting machine determine the number of colors that may be used within the corresponding section or column of product that the needle tufts. Generally, tufting machines comprise six creels per needle. Therefore, each column or section of product may have no more than six colors. Likewise, each portion 112 of the pattern 105 that corresponds to each column or section of finished product may have no more than six colors.

To determine the portion 112 of pattern 105 that corresponds to the section or column of product that each needle tufts, the machine data of the particular tufting machine may be examined. Based on the gauge of the needles, the number of tufts per inch may be calculated. For example, a tufting machine with a 1/10 gauge may generate ten tufts per inch of product. The gauge of the needles may generally correspond to the pixels per inch of the pattern 105. Using the example above, ten pixels of the pattern 105 correspond to one inch of finished product. Each needle of the tufting machine generally tufts a predetermined width of product. Accordingly, if each needle of a tufting machine tufts two inches of product, then each needle corresponds to twenty pixels of the pattern 105.

As illustrated in FIGS. 1A-1B, the pattern 105 may be divided into pixel portions 112 representing the section or column associated with each needle 315F-O, 318F-N. In an exemplary embodiment of the present invention, each pixel portion 112 is examined to determine if it comprises more colors than may be associated with the corresponding needle. If too many colors are present within the pixel portion 112 of the pattern 105, then the pattern 105 is determined to be invalid for the particular tufting machine. The present invention may also generate an error that indicates the reason why the pattern 105 has been determined invalid. For example and not limitation, the present invention may generate an error indicating that the third pixel portion associated with needle 315G comprises more than six colors. Such informative error messages allow a designer to attempt to fix the pattern 105 for validity. If each pixel portion 112 of the pattern 105 does not comprise more than the predetermined number of colors, then the pattern 105 is determined to be valid for the particular tufting machine.

Figure 2:
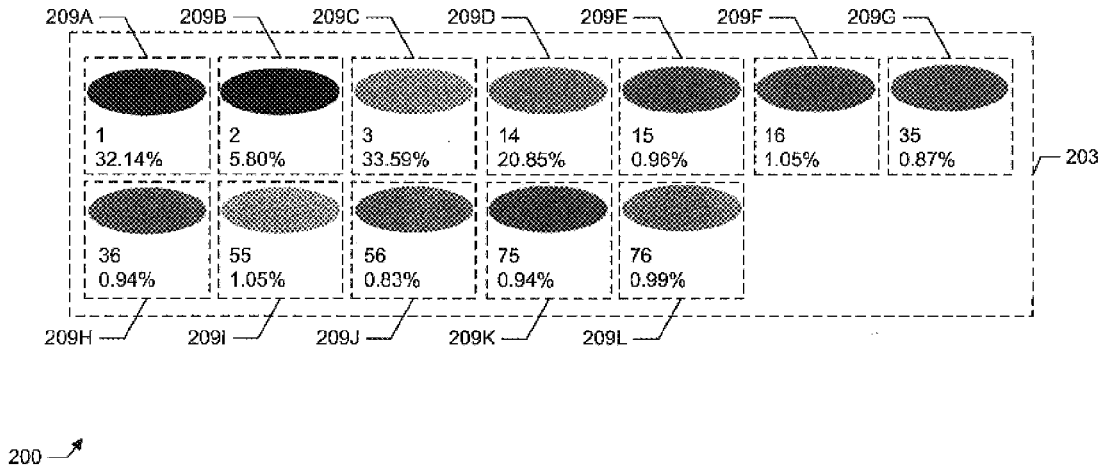
FIG. 2 displays a diagram representation of a color palette in accordance with an exemplary embodiment of the present invention.

FIG. 2 displays a diagram representation 200 of a color palette 203 in accordance with an exemplary embodiment of the present invention. Once a pattern 105 has been validated for a particular tufting machine, the present invention may determine the colors present within the pattern 105. Determining the colors present within the pattern 105 enables a tufting machine operator to acquire the appropriate colors of yarn necessary for the tufting machine to implement the pattern 105. One skilled in the art will recognize that the determination of colors present within the pattern 105 may be accomplished simultaneously with the validation of the pattern 105, described above with reference to FIGS. 1A-1B.

In order to implement the pattern 105 on a particular tufting machine, the operator of the tufting machine needs a list of appropriate colors to be loaded onto the tufting machine. In an exemplary embodiment of the present invention, the list of appropriate colors may be determined by examining the pixels of the pattern 105. Additionally, the present invention may calculate the percentage of each color that is used within the pattern 105 by dividing the number of pixels of a particular color by the number of pixels of the entire pattern 105. The percentage of each color informs the operator of the tufting machine on the quantity of yarn for each color that is needed to implement a predetermined amount of carpet with the pattern 105. A report may be generated including a color palette 203 that comprises each color of the pattern 105 and each corresponding percentage 209A-L. The operator of the tufting machine may use the color palette 203 of the report to acquire the correct colors of yarn to place on the creels of the tufting machine.

Color palette 203 indicating the colors present in pattern 105 is for exemplary purposes only. One skilled in the art will recognize that other valid patterns exist and, therefore, other color palettes may be used within the scope of the present invention. Accordingly, the present invention is not limited to the color palette 203 illustrated in FIG. 2.

Figure 3:
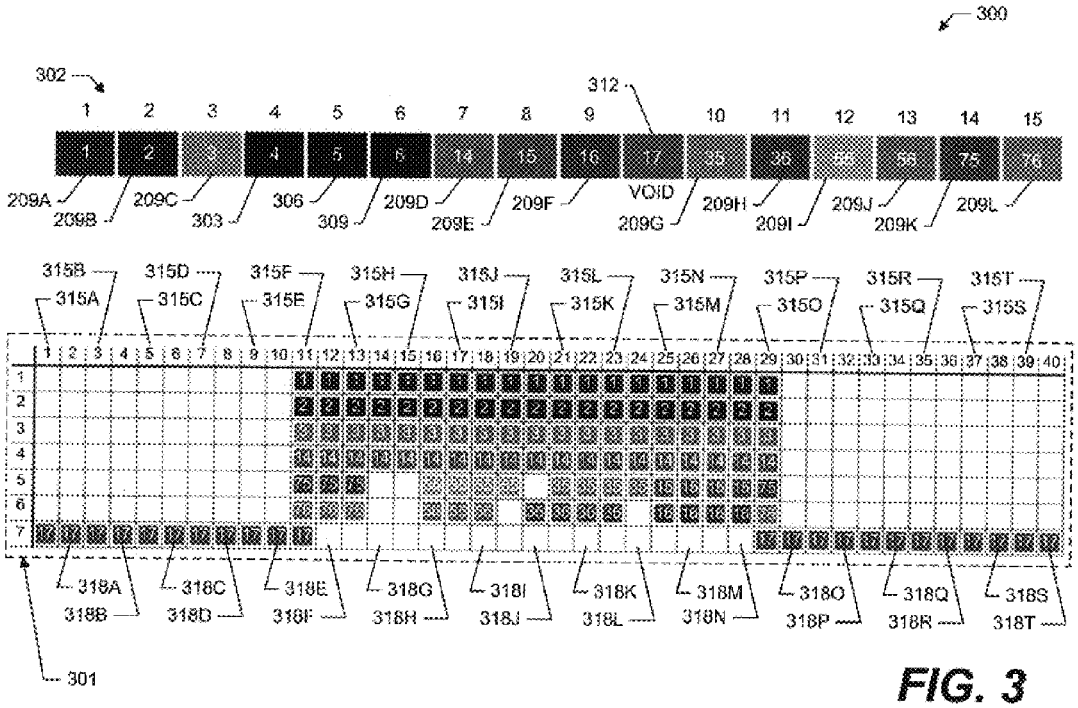
FIG. 3 displays a diagram representation of a chart indicating colors associated with needles of a tufting machine in accordance with an exemplary embodiment of the present invention.

FIG. 3 displays a diagram representation of a chart 301 indicating colors associated with needles 315A-T, 318A-T of a tufting machine in accordance with an exemplary embodiment of the present invention. Although a valid pattern 105 may exist for a particular tufting machine, the operator of the tufting machine will not necessarily know how to load the tufting machine appropriately to implement such pattern 105. Accordingly, the present invention may generate a loading chart 301 to provide the operator of the tufting machine with instructions on how to load the creels associated with each needle of the tufting machine. Additionally, a color bar 302 may be generated to instruct the operator of the tufting machine on which colors are used with each needle of the tufting machine. The operator need only follow the color bar 302 and loading chart 301 to successfully load a particular tufting machine with yarn to implement the pattern 105. One skilled in the art will recognize that the generation of the loading chart 301 and color bar 302 may be accomplished simultaneously with the validation of the pattern 105, described above with reference to FIGS. 1A-1B.

In an exemplary embodiment of the present invention, a report may be generated comprising a color bar 302 which indicates the colors to be loaded on the particular tufting machine and a loading chart 301 that illustrates the appropriate colors to load on the creels of each needle 315A-T, 318A-T of the tufting machine.

FIG. 3 illustrates a loading chart 301 displaying the color assignment for each needle of a tufting machine with reference to pattern 105 of FIGS. 1A-1B. Although the loading chart 301 in FIG. 3 illustrates that the applicable tufting machine has forty needles 315A-T, 318A-T (e.g., the needles are represented by the columns in the loading chart 301 ), one skilled in the art will recognize that the scope of the present invention may include tufting machines of various needle counts, including a typical tufting machine having ninety-six needles. Additionally, a pattern 105 may not require the use of all needles present on a particular tufting machine. As shown in FIG. 3, only nineteen needles 315F-O, 318F-N will be necessary to implement pattern 105 into a finished product. Accordingly, loading chart 301 displays only nineteen needles 315F-O, 318F-N having colors for the corresponding six creels (e.g., the creels are represented by rows in the loading chart 301).

To determine the colors associated with each needle 315A-T, 318A-T of the tufting machine, the pixels of each portion 112 of pattern 105 are examined. For example, the portion 112 of pattern 105 associated with needle 315F includes colors 209A, 209B, 209C, 209D, 209K and 209L. In an another embodiment of the present invention, the amount of yarn for each color needed at each needle 315A-T, 318A-T of the tufting machine may be calculated based on machine specifications, yarn weight per square yard, and total number of square yards of product to be processed. The calculated amount of yarn for each color needed at each needle 315A-T, 318A-T may assist the operator of the tufting machine in ensuring that enough yarn is loaded with each needle 315A-T, 318A-T. In yet another embodiment of the present invention, the initial number of cones of each color necessary to create pattern 105 on a particular tufting machine may be calculated by enumerating the number of needles 315, 318 within the loading chart 301 comprising a particular color. Table 1 summarizes such a calculation with reference to pattern 105 of FIGS. 1A-1B.

TABLE 1

| Cone Count Summary | |
|---|---|
| Palette Position 1: | 19 initial cones |
| Palette Position 2: | 19 initial cones |
| Palette Position 3: | 19 initial cones |
| Palette Position 4: | 0 initial cones |
| Palette Position 5: | 0 initial cones |
| Palette Position 6: | 0 initial cones |
| Palette Position 14: | 19 initial cones |
| Palette Position 15: | 4 initial cones |
| Palette Position 16: | 4 initial cones |
| Palette Position 17: | 23 VOID cones |
| Palette Position 35: | 4 initial cones |
| Palette Position 36: | 4 initial cones |
| Palette Position 55: | 4 initial cones |
| Palette Position 56: | 3 initial cones |
| Palette Position 75: | 4 initial cones |
| Palette Position 76: | 4 initial cones |

A report may be generated comprising a color bar 302 representing the colors of the color palette 203, a loading chart 301 indicating the colors of yarn to load on the creels of each needle of the tufting machine, a summary of the initial cones required for loading the tufting machine, and/or the amount of yarn necessary for each color at each needle position of the tufting machine. The operator may use the report to appropriately load the particular tufting machine, so that the pattern 105 may be produced.

Color bar 302 and chart 301 indicating the colors associated with needles 315A-T, 318A-T illustrated in FIG. 3 are for exemplary purposes only and correspond to pattern 105 illustrated in FIGS. 1A-1B. One skilled in the art will recognize that other valid patterns exist and, therefore, other color bars and charts may be used within the scope of the present invention. Accordingly, the present invention is not limited to the color bar 302 and the chart 301 illustrated in FIG. 3.

Figure 4:
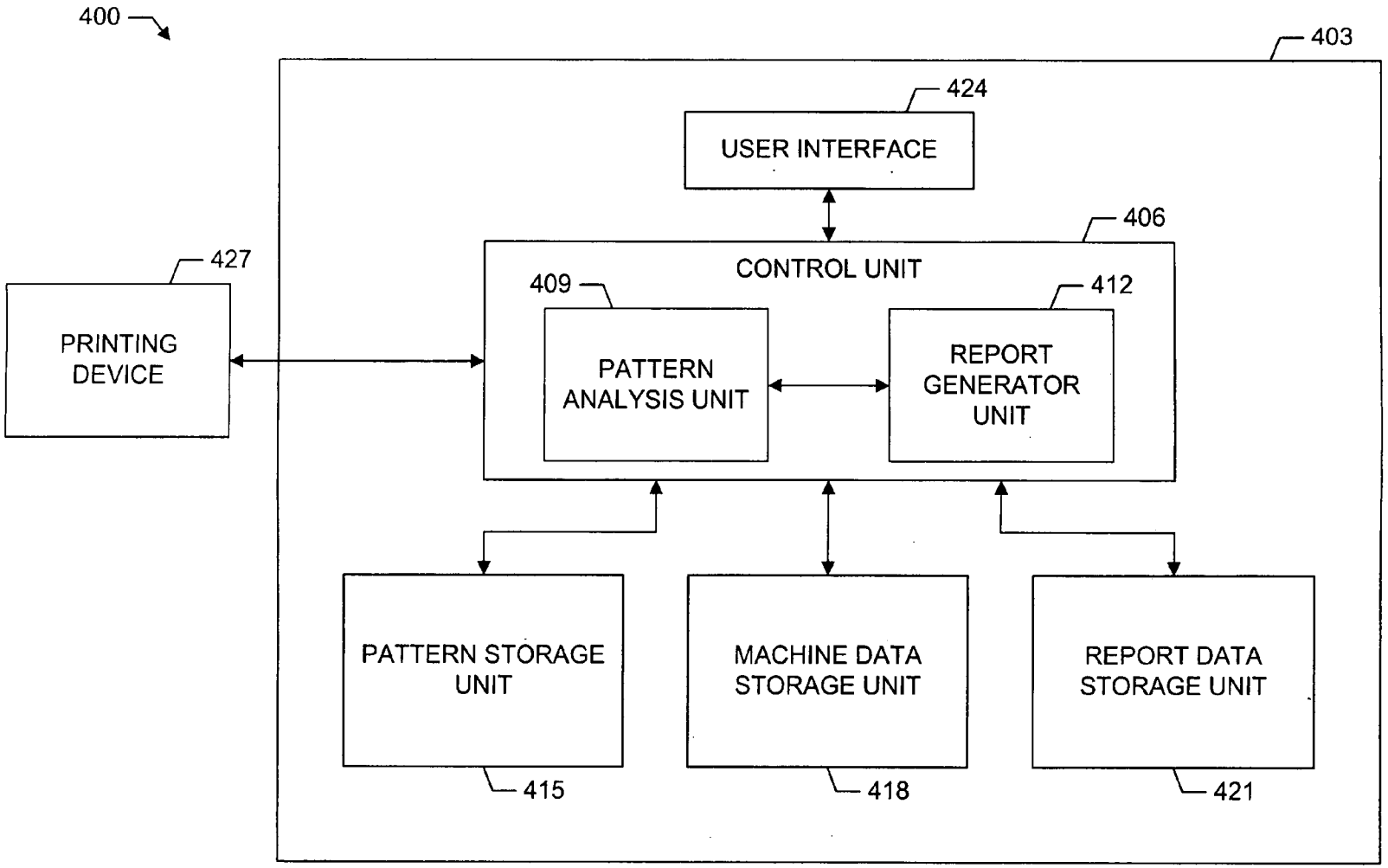
FIG. 4 displays a block diagram representation of a system environment in accordance with an exemplary embodiment of the present invention.

FIG. 4 and the following discussion provide a general overview of a system 400 onto which the exemplary embodiment of the present invention, or portions thereof, may be implemented. Those skilled in the art will appreciate that the system environment 400 illustrated in FIG. 4 may take on many forms and may be directed towards performing a variety of functions. Generally, the system environment 400 comprises a communication device 403 which may be configured with hardware and software (see FIG. 5) appropriate to perform tasks and provide capabilities and functionality as described herein. More specifically, the communication device 403 comprises a control unit 406, a pattern storage unit 415, a machine data storage unit 418, and a report data storage unit 421.

The pattern storage unit 415 communicatively connects to the control unit 406. The pattern storage unit 415 stores pattern data (e.g., image data) used by a tufting machine to produce a carpet product resembling the stored pattern data. Pattern data may be represented in multiple image formats including bitmap, tagged image file format (TIFF), graphics interchange format (GIF), portable network graphics (PNG), joint photographic experts group format (JPEG), or any other convenient image format. The pattern storage unit 415 comprises a memory device capable of storing and retrieving data including, but not limited to, random access memory (RAM), flash memory, magnetic memory devices, optical memory devices, hard disk drives, removable volatile or non-volatile memory devices, optical storage mediums, magnetic storage mediums, or RAM memory cards. Alternatively, the pattern storage unit 415 may comprise a remote storage facility accessible through a wired and/or wireless network system. Additionally, the pattern storage unit 415 may comprise a memory system including a multi-stage system of primary and secondary memory devices, as described above. The primary memory device and secondary memory device may operate as a cache for each other or the secondary memory device may serve as a backup to the primary memory device. In yet another arrangement, the pattern storage unit 415 may comprise a memory device configured as a simple database file or as a searchable, relational database using a query language, such as structured query language (SQL).

The machine data storage unit 418 communicatively connects to the control unit 406. The machine data storage unit 418 stores machine parameters representing the specifications of a particular machine(s). For example and not limitation, the machine parameters may include the number of needles available on a tufting machine, the appropriate gauge of the tufting machine, the number of creels associated with each needle, and the width of the section or column tufted by each needle. The machine data storage unit 418 comprises a memory device similar to the memory devices described above with reference to the pattern storage unit 415.

The report data storage unit 421 communicatively connects to the control unit 406. The report data storage unit 421 stores report data generated by the control unit 406 upon analyzing a pattern from the pattern storage unit 415. Report data (described more fully above with reference to FIG. 2 and FIG. 3) may include, but is not limited to, a palette of yarn colors represented in the pattern, a chart indicating which yarn colors are used with each needle position of the tufting machine, and a summary of the number of yarn cones needed for each color of yarn. The report data storage unit 421 comprises a memory device similar to the memory devices described above with reference to the pattern storage unit 415.

The control unit 406 is configured with hardware and software (see FIG. 5) appropriate to perform tasks and provide capabilities and functionality as described herein. The control unit 406 may receive pattern data from the pattern storage unit 415 and machine data from the machine data storage unit 418. Generally, the control unit 406 determines the palette of colors within the pattern, the percentage of colors within the palette to be assigned to each of the needle positions of the tufting machine specified by the machine data, and the number of yarn cones necessary to produce the pattern on the tufting machine. Accordingly, the control unit 406 comprises a pattern analysis unit 409 and a report generator unit 412. Both the pattern analysis unit 409 and report generator unit 412 are configured with hardware and software (see FIG. 5) appropriate to perform tasks and provide capabilities and functionality as described herein. The pattern analysis unit 409 typically examines each pixel of the pattern data received from the pattern storage unit 415. Based on the examination of each pixel, the pattern analysis unit 409 may determine the percentage of each color within the pattern data. Using the machine parameters from the machine data storage unit 418, the pattern analysis unit 409 may determine whether the predetermined tufting machine is capable of implementing the present pattern. Additionally, the pattern analysis unit 409 may determine the percentages of each color within the pattern to assign to each needle position of the tufting machine. Using the percentage of each color assigned to each needle position and the predetermined size of carpet to be produced, the pattern analysis unit 409 may determine the amount of yarn cones needed to create the pattern and how the yarn cones may be loaded onto the creels associated with each needle of the tufting machine. The pattern analysis unit 409 communicatively connects to the report generator unit 412. The report generator unit 412 receives the data generated by the pattern analysis unit 409 and creates a report including, but not limited to, the palette of colors represented in the pattern, a chart indicating which yarns are used with each needle position of the tufting machine, and a summary of the number of yarn cones needed for each color within the palette. The report generated by the report generator unit 412 may be displayed, printed, or stored in the report data storage unit 421.

The system environment 400 further comprises a printing device 427 which communicatively connects to the communication device 403 via the control unit 406. The printing device 427 may receive report data generated by the report generator unit 412 through an output interface 526. One skilled in the art will recognize that the printing device 427 may be located on a network (not shown), such as a local area network or a wide-area network. Accordingly, the printing device 427 may reside on a remote system 538 and may receive data through a network interface 528.

The communication device 403 also comprises a user interface 424 that may be adapted to display data to a user and receive user input. The user interface 424 communicatively connects to the control unit 406. Generally, the user interface 424 receives and displays report data generated by the report generator unit 412 of the control unit 406. Additionally, the user interface 424 may receive user input including, but not limited to, tufting machine parameters or specifications and pattern data. One skilled in the art will recognize that the user interface 424 may be designed in a variety of embodiments and formats and may range from a simple to a more complex configuration. In an exemplary embodiment of the present invention, the user interface 424 may comprise a keypad, display, touch screen or other convenient device, and may also comprise program modules or machine instructions that perform the above-described tasks, which instructions may be executed on a processing unit 512.

In operation, a user may provide pattern data through the user interface 424. The user may provide the pattern data by scanning in an image, creating a new pattern via the user interface 424, or selecting a pattern stored on the pattern storage unit 415. If the user scans in an image or creates a new pattern on the user interface 424, the pattern may then be stored on the pattern storage unit 415. After providing the pattern data, the user may request to print the pattern via the user interface 424. The user interface 424 provides the print request to the control unit 406, which provides the pattern data to the printing unit 427.

Through the user interface 424, the user may provide the parameters or specifications of a specific tufting machine including, but not limited to, the number of needles on the tufting machine, the width of the section or column tufted by each needle, and the appropriate gauge of the tufting machine. The user interface 424 provides the machine parameters entered by the user to the control unit 406 which, in turn, provides the machine parameters to the machine data storage unit 418 for storage.

Using the provided pattern stored on the pattern storage unit 415 and the machine parameters stored on the machine data storage unit 418, the pattern analysis unit 409 analyzes each pixel of the pattern and determines the percentage of colors within the pattern, the percentages of colors associated with each needle position of the tufting machine, and the number of yarn cones needed for each color within the pattern. The pattern analysis unit 409 provides the determined data to the report generator unit 412 which generates report data including, but not limited to, the color palette of the pattern, a chart indicating which colors of yarn are used with each needle position, and a summary of the number of yarn cones needed for each color. The control unit 406 may provide the report data to the user interface 424 for display to a user and/or may provide the report data to the report data storage unit 421 for storage. Additionally, the report data may be provided by the control unit 406 to the printing device 427 for printing or may be exported by the control unit 406 into a desired format for remote storage or processing.

One skilled in the art will recognize that connecting communicatively may include any appropriate type of connection including, but not limited to, analog, digital, wireless and wired communication channels. Such communication channels include, but are not limited to, copper wire, optical fiber, radio frequency, infrared, satellite, or other medium.

Figure 5:
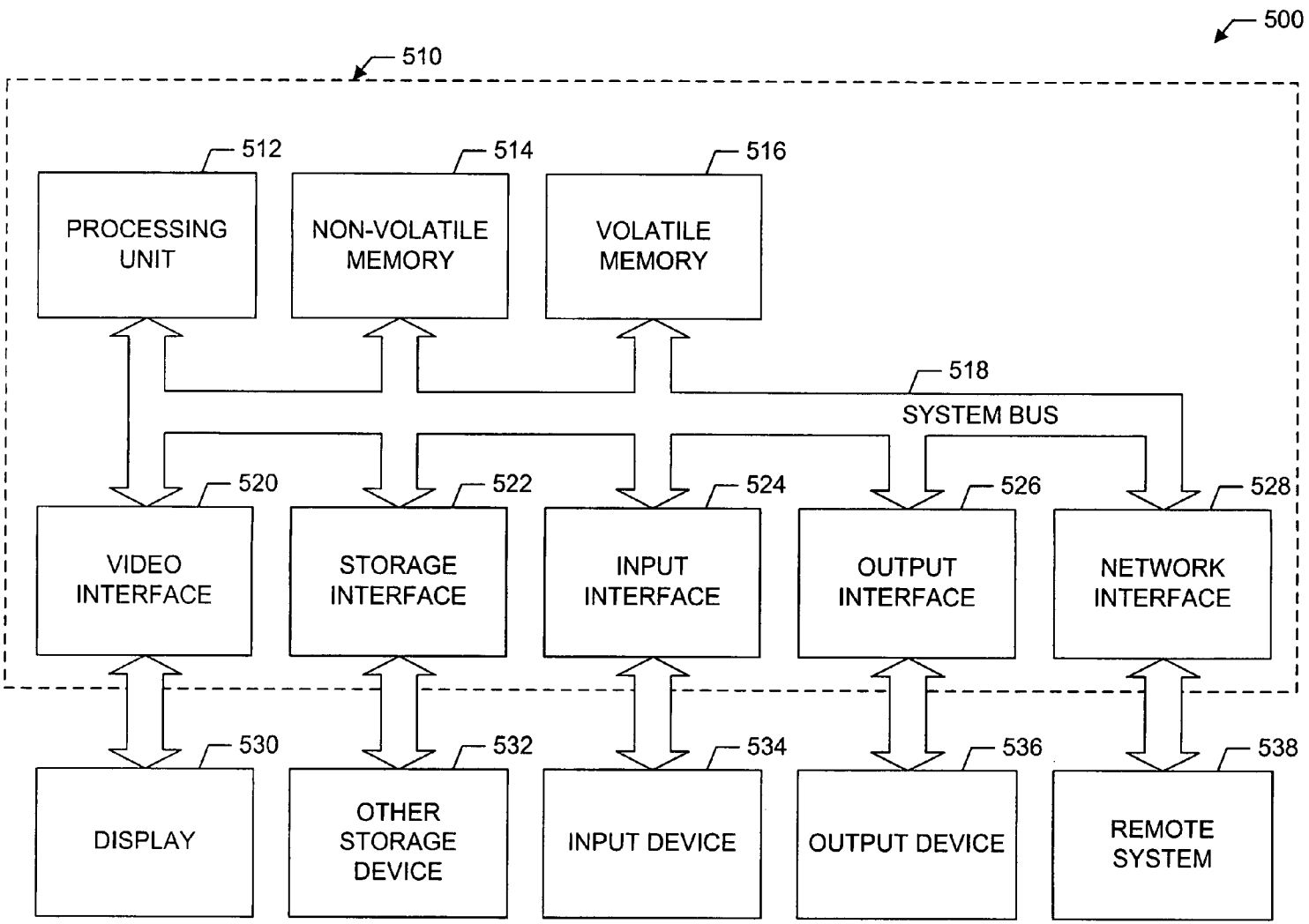
FIG. 5 displays a block diagram representation of an exemplary computing environment in which the present invention may be implemented.

FIG. 5 and the following discussion provide a general overview of a platform onto which the exemplary embodiment of the present invention, or portions thereof, may be integrated, implemented and/or executed. Although in the context of portions of an exemplary environment, the invention may be described as consisting of instructions within a software program being executed by a processing unit, those skilled in the art will understand that portions of an exemplary embodiment of the present invention, or the entire invention itself may also be implemented by using hardware components, state machines, or a combination of any of these techniques. In addition, a software program implementing an embodiment of the present invention may run as a stand-alone program or as a software module, routine, or function call, operating in conjunction with an operating system, another program, system call, interrupt routine, library routine, or the like. The term program module may be used to refer to software programs, routines, functions, macros, data, data structures, or any set of machine readable instructions or object code, or software instructions that may be compiled into such, and executed by a processing unit 512.

Those skilled in the art will appreciate that the computing environment illustrated in FIG. 5 may take on many forms and may be directed towards performing a variety of functions. Generally, the computing environment illustrated in FIG. 5 may be any system that includes a computer processor. Examples of such forms and functions include, but are not limited to, personal computers, hand-held devices such as personal data assistants, note-book computers, mobile telephones, lap-top computers, mainframe computers, servers and a variety of other applications, each of which may serve as an exemplary environment for embodiments of the present invention.

The exemplary computing device 510 (e.g., communication device 403) may comprise various components including, but not limited to, a processing unit 512, non-volatile memory 514, volatile memory 516, and a system bus 518 that couples the non-volatile memory 514 and volatile memory 516 to the processing unit 512. The non-volatile memory 514 may include a variety of memory types including, but not limited to, read only memory (ROM), electronically erasable read only memory (EEROM), electronically erasable and programmable read only memory (EEPROM), electronically programmable read only memory (EPROM), electronically alterable read only memory (EAROM), FLASH memory, bubble memory, battery backed random access memory (RAM), CDROM, digital versatile disks (DVD) or other optical disk storage, magnetic cassettes, magnetic tape, magneto-optical storage devices, magnetic disk storage or other magnetic storage devices, or any other medium which may be used to store the desired information. The non-volatile memory 514 may provide storage for power-on and reset routines (bootstrap routines) that are invoked upon applying power or resetting the computing device 510. In some configurations the non-volatile memory 514 may provide the basic input/output system (BIOS) routines that may be utilized to perform the transfer of information between elements within the various components of the computing device 510.

The volatile memory 516 may include, but is not limited to, a variety of memory types and devices including, but not limited to, random access memory (RAM), dynamic random access memory (DRAM), bubble memory, registers, or the like. The volatile memory 516 may provide temporary storage for routines, modules, functions, macros, data etc. that are being or may be executed by, or are being accessed or modified by, the processing unit 512.

Alternatively, the non-volatile memory 514 and/or the volatile memory 516 may comprise a remote storage facility accessible through a wired and/or wireless network system. Additionally, the non-volatile memory 514 and/or the volatile memory 516 may comprise a memory system comprising a multi-stage system of primary and secondary memory devices, as described above. The primary memory device and secondary memory device may operate as a cache for the other or the second memory device may serve as a backup to the primary memory device. In yet another arrangement, the non-volatile memory 514 and/or the volatile memory 516 may comprise a memory device configured as a simple database file or as a searchable, relational database using a query language, such as SQL.

The computing device 510 may access one or more external display devices 530 such as a CRT monitor, LCD panel, LED panel, electro-luminescent panel, or other display device, for the purpose of providing information or computing results to a user. In some embodiments, the external display device 530 may actually be incorporated into the product itself. The processing unit 512 may interface to each display device 530 through a video interface 520 coupled to the processing unit 512 over the system bus 518.

The computing device 510 may send output information, in addition to the display 530, to one or more output devices 536 such as a speaker, modem, printer, plotter, facsimile machine, RF or infrared transmitter, computer or any other of a variety of devices that may be controlled by the computing device 510. The processing unit 512 may interface to each output device 536 through an output interface 526 coupled to the processing unit 512 over the system bus 518.

The computing device 510 may receive input or commands from one or more input devices 534 such as a keyboard, pointing device, mouse, modem, RF or infrared receiver, microphone, joystick, track ball, light pen, game pad, scanner, camera, computer or the like. The processing unit 512 may interface to each input device 534 through an input interface 524 coupled to the processing unit 512 over the system bus 518.

It will be appreciated that program modules implementing various embodiments of the present invention may be stored in the non-volatile memory 514, the volatile memory 516, or in a remote memory storage device accessible through the output interface 526 and the input interface 524. The program modules may include an operating system, application programs, other program modules, and program data. The processing unit 512 may access various portions of the program modules in response to the various instructions contained therein, as well as under the direction of events occurring or being received over the input interface 524.

The computing device 510 may provide data to and receive data from one or more other storage devices 532, which may provide volatile or non-volatile memory for storage and which may be accessed by computing device 510. The processing unit 512 may interface to each storage device 532 through a storage interface 522 over the system bus 518.

The interfaces 520, 522, 524, 526, and 528 may include one or more of a variety of interfaces, including but not limited to, cable modems, DSL, T1, V series modems, an RS-532 serial port interface or other serial port interface, a parallel port interface, a universal serial bus (USB), a general purpose interface bus (GPIB), an optical interface such as infrared or IrDA, an RF or wireless interface such as Bluetooth, or other interface.

Figure 6:
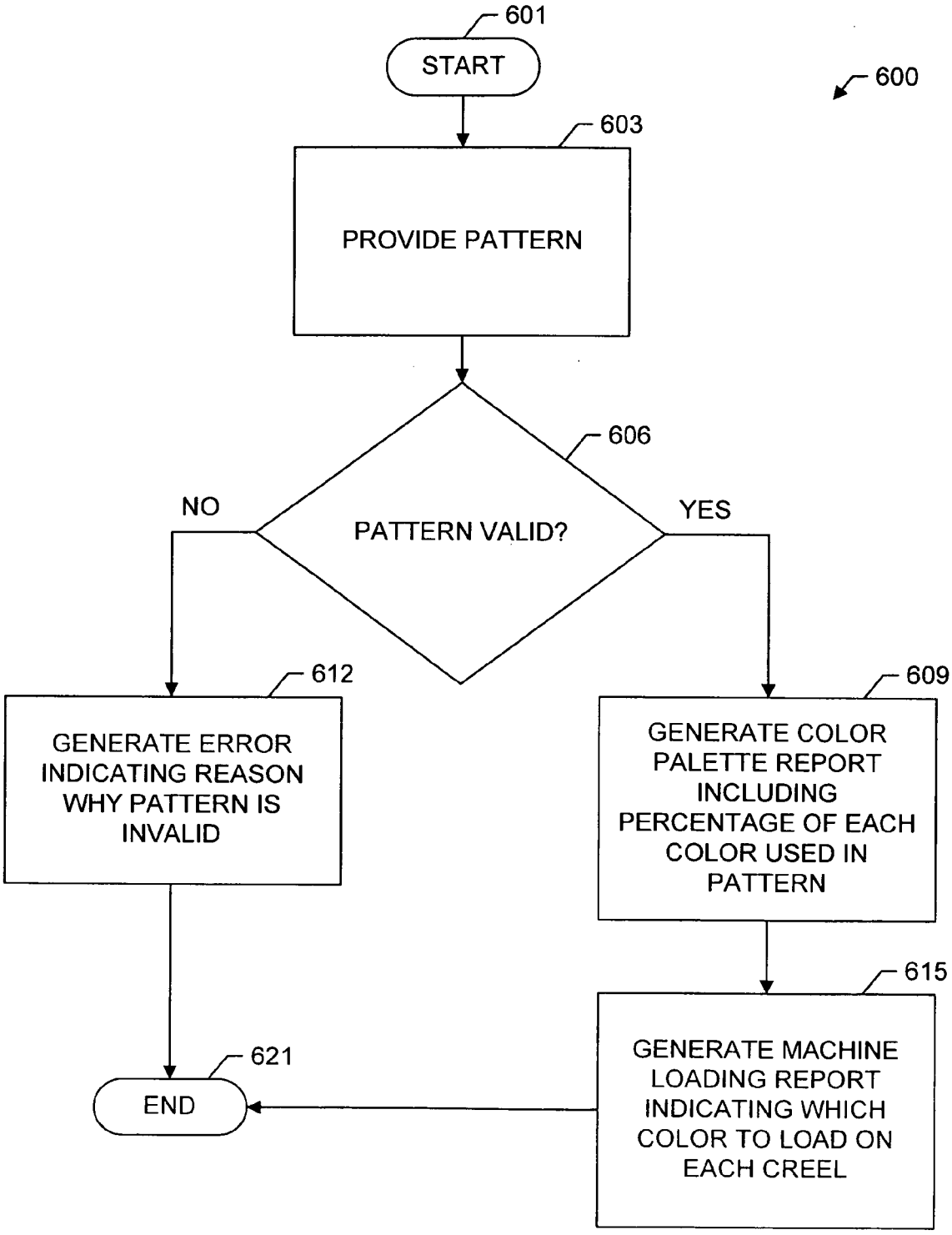
FIG. 6 displays a flowchart representation of a method of generating reports concerning a pattern with reference to a particular tufting machine in accordance with an exemplary embodiment of the present invention.
Figure 7A:
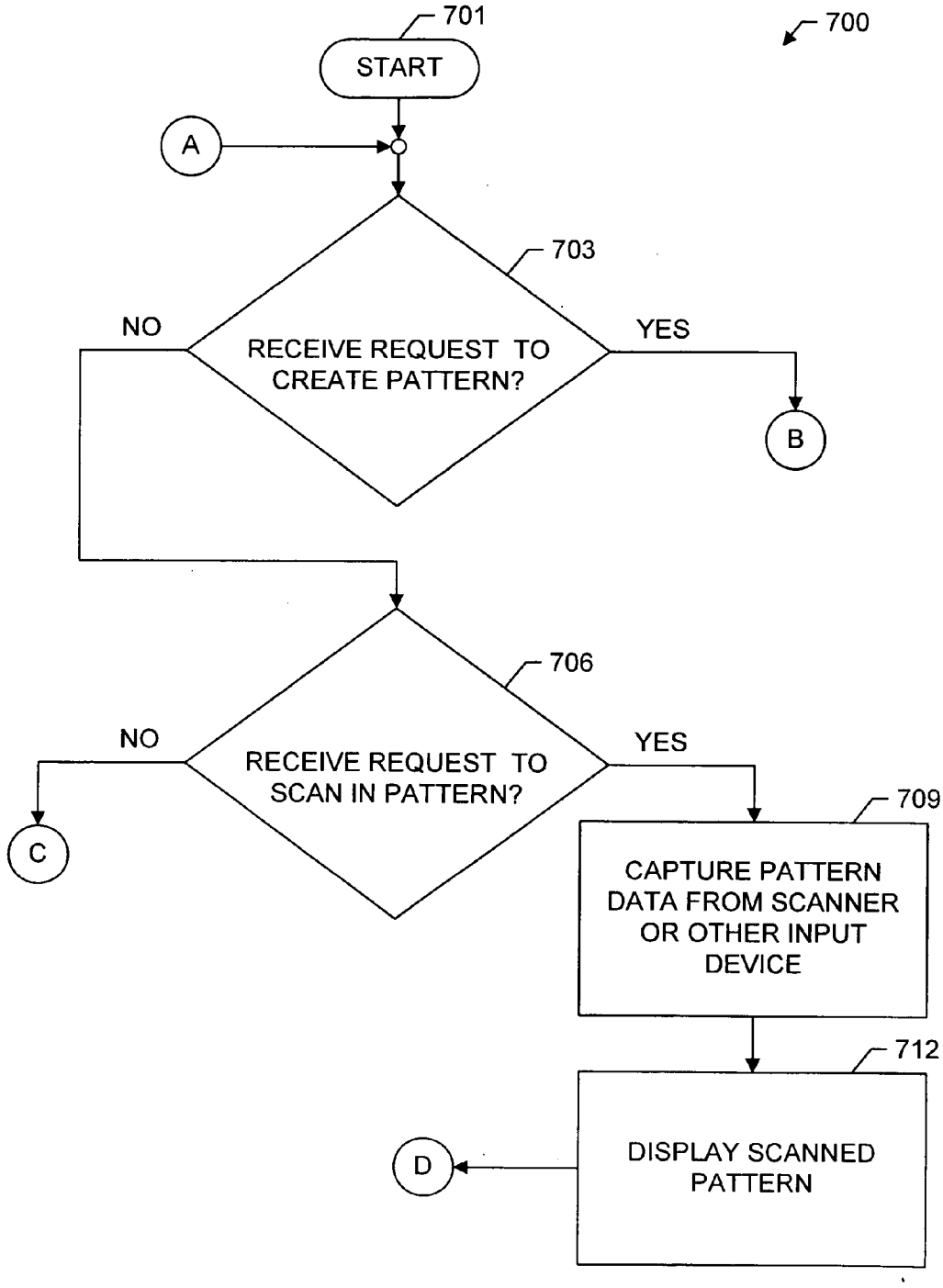
FIGS. 7A-7D display a flowchart representation of a method of providing a pattern in accordance with an exemplary embodiment of the present invention.
Figure 7B:
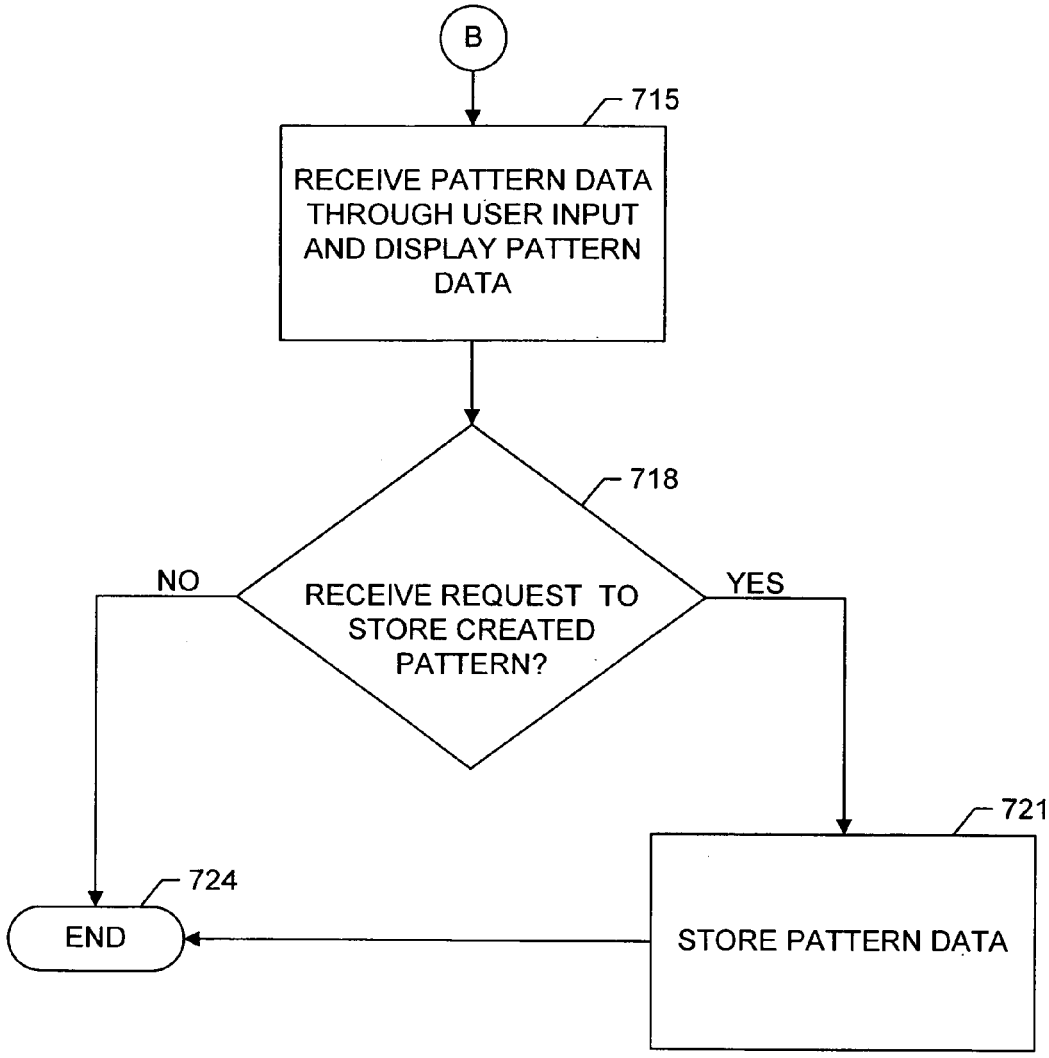
Figure 7C:
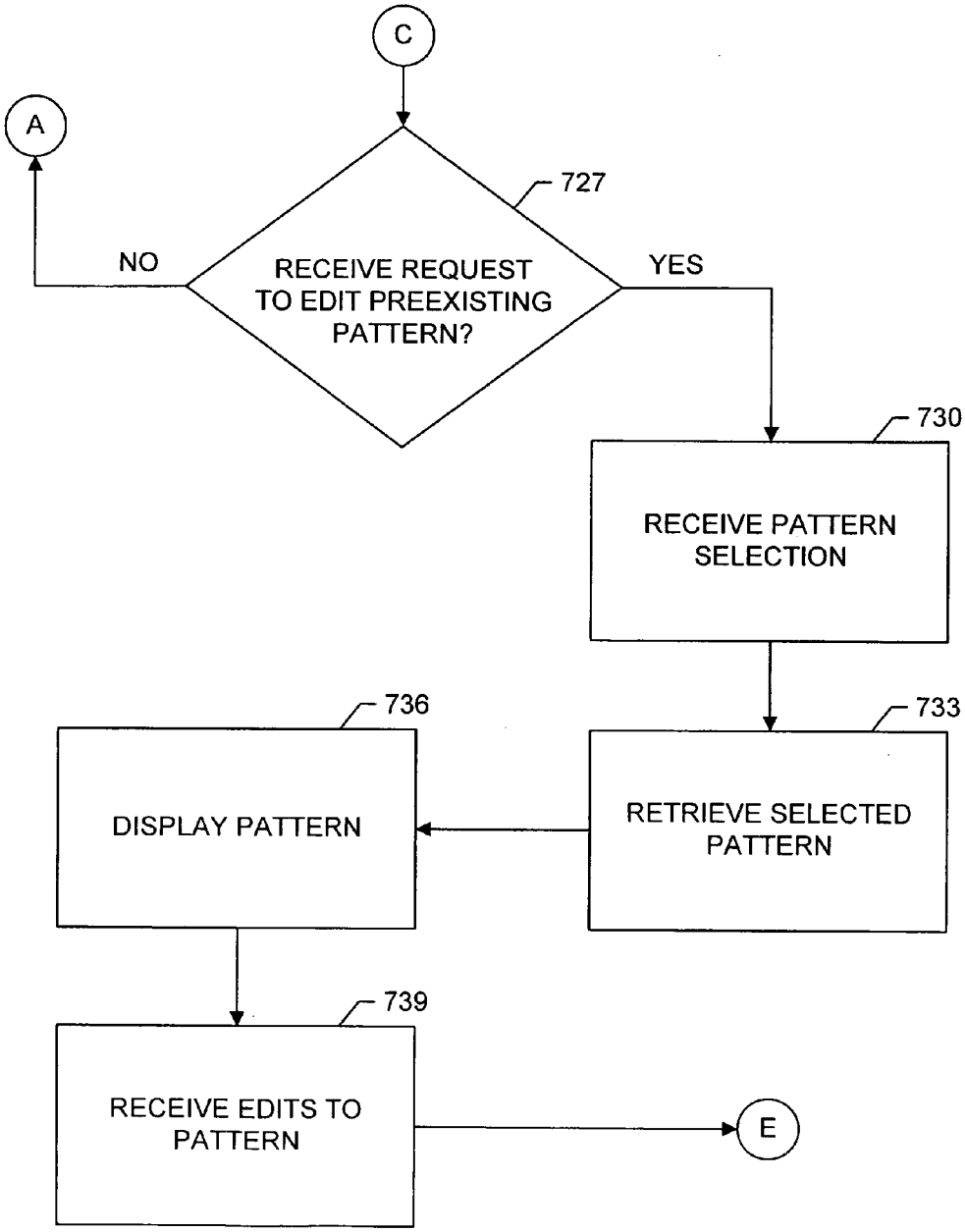
Figure 7D:
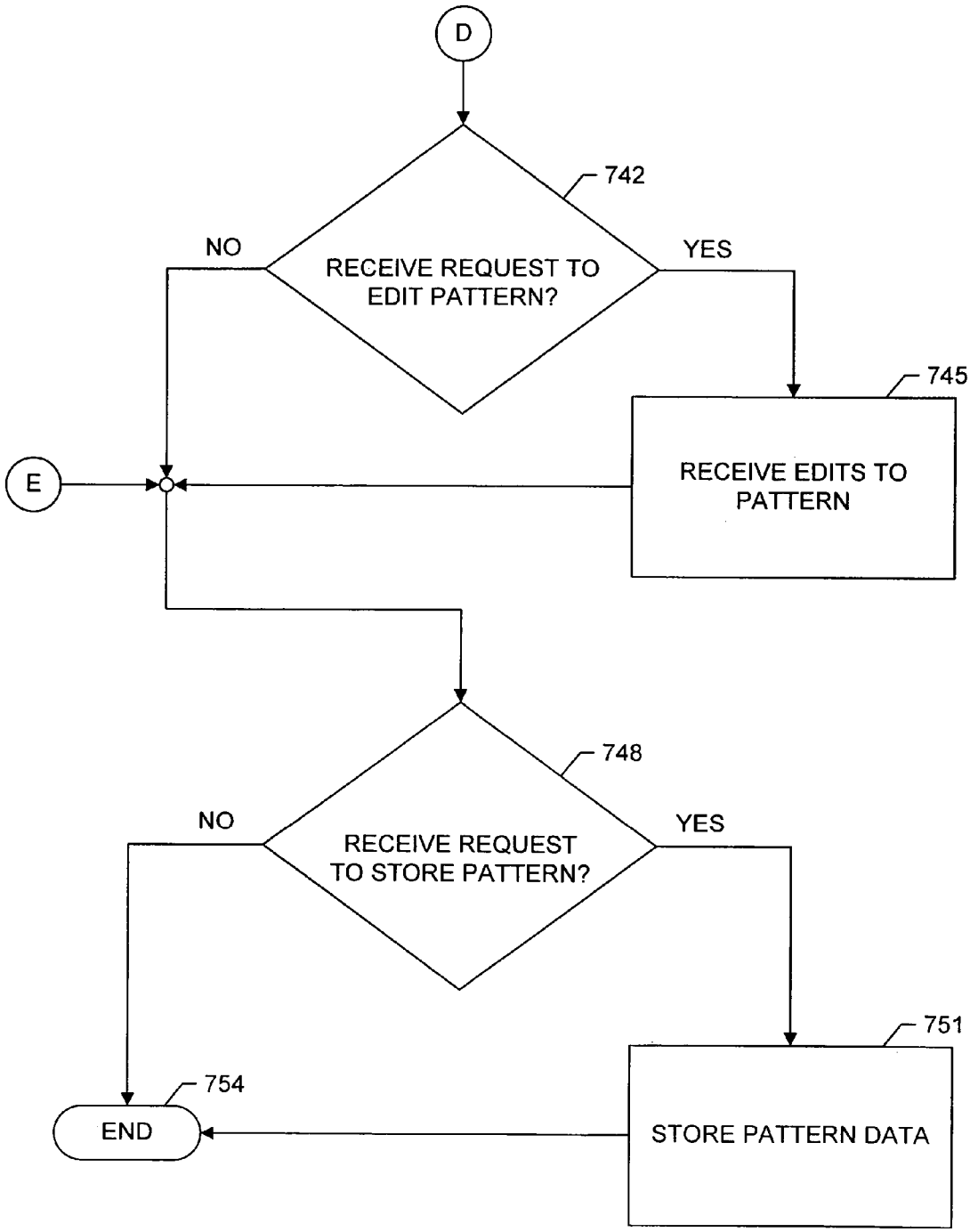

FIG. 6 displays a flowchart representation of a method 600 of generating reports concerning a pattern 105 with reference to a particular tufting machine in accordance with an exemplary embodiment of the present invention. As described above, each pattern 105 must be examined with reference to a particular tufting machine to determine if the pattern 105 is valid (e.g., may physically be implemented on the particular tufting machine). If the pattern 105 is determined to be valid, then a report may be generated including the color palette 203 of the pattern 105 and a machine loading chart 301 indicating how to load each creel of the tufting machine.

After beginning at 601, the control unit 406 proceeds to 603 where a user provides a pattern 105 to be implemented on a particular tufting machine. Once the pattern 105 has been provided, the control unit 406 proceeds to 606 where the control unit 406 determines whether the pattern 105 is valid based on the parameters or specifications of a particular tufting machine. For example, if the tufting machine comprises six creels for each needle, then the control unit 406 may determine whether each column or section of the pattern 106 (associated with each needle of the tufting machine) is limited to six or fewer colors. If, at 606, the control unit 406 determines that the pattern 105 is not valid, then the control unit 406 proceeds to 612 where the control unit 406 generates an error indicating the reason or reasons why the pattern 106 has been determined invalid. For example, the control unit 406 may generate an error that indicates that a particular column or section of the pattern comprises more than six colors. The control unit 406 provides the error to the user interface 424 for display to the user. The control unit 406 then halts operation in accordance with method 600 at 621.

If, however, at 606 the control unit 406 determines that the provided pattern 105 is valid, then the control unit 406 proceeds to 609 where the control unit 406 generates a color palette 203 including the percentage of each color used within the pattern 105. Next, at 615, the control unit 406 generates a machine loading report 301 that indicates which color to load on each creel of the tufting machine. The control unit 406 then terminates operation in accordance with method 600 at 621.

FIGS. 7A-7D display a flowchart representation of a method 700 of providing a pattern 105 in accordance with an exemplary embodiment of the present invention. A pattern 105 is provided for analysis to determine if the pattern 105 is valid for the particular tufting machine and to determine the percentages and physical amounts of each yarn color to associate with the needle positions of the tufting machine. Providing such a pattern 105 may be accomplished in a variety of ways including, but not limited to, creating a pattern 105 via the user interface 424, scanning in a pattern 105 to be imported into the system environment 400 for analysis, and selecting a pattern 105 that has been stored in the pattern storage unit 415.

After beginning at 701, the control unit 406 proceeds to 703 where the control unit 406 determines whether a request to create a pattern 105 has been received from the user via the user interface 424. If at 703, the control unit 406 determines that a request to create a pattern 105 has been received from the user via the user interface 424, then the control unit 406 proceeds to 715, described below. If, however, at 703, the control unit 406 determines that a request to create a pattern 305 has not been received from the user via the user interface 424, then the control unit 406 proceeds to 706 where the control unit 406 determines whether a request to scan in a pattern 105 has been received from the user via the user interface 424. If at 706, the control unit 406 determines that a request to scan in a pattern 105 has not been received from the user via the user interface 424, then the control unit 406 proceeds to 727, described below. If, however, at 706 the control unit 406 determines that a request to scan in a pattern 105 has been received from the user via the user interface 424, then the control unit 406 proceeds to 709 where the control unit 406 captures the pattern data from an input device, such as a scanner, via the user interface 424. Next, at 712 the captured pattern data is displayed to the user via the user interface 424. The control unit 406 proceeds to 742, described below.

At 715, the control unit 406 receives pattern data through user input via the user interface 424. The received pattern data is then displayed to the user via the user interface 424. Next, at 718, the control unit 406 determines whether a request to store the pattern data has been received from the user via the user interface 424. If, at 718 the control unit 406 determines that no request was made by the user via the user interface 424 to store the pattern data, then the control unit 406 halts operation in accordance with method 700 at 724. Otherwise, if at 718 the control unit 406 determines that a user has requested, via the user interface 424, to store the pattern data then the control unit 406 proceeds to 721 where the control unit 406 provides the pattern data to the pattern storage unit 415 for storage. The control unit 406 then terminates operation in accordance with method 700 at 724.

At 727, the control unit 406 determines whether a request to edit a preexisting pattern 105 has been received from the user via the user interface 424. If, at 727, the control unit 406 determines that a request to edit a preexisting pattern 105 has not been received from the user via the user interface 424, then the control unit 406 proceeds to 703, described above. If, however, at 727 the control unit 406 determines that a request to edit a preexisting pattern 105 has been received from the user via the user interface 424, then the control unit 406 proceeds to 730 where the control unit 406 receives a selection from the user via the user interface 424 of a pattern 105 stored on the pattern storage unit 415. Next, the control unit 406 retrieves the selected pattern 105 from the pattern storage unit 415 and provides the pattern data to the user interface 424 for display 736. Then, the display unit 406 receives edits of the pattern from the user via the user interface 424 at 739. The control unit 406 then proceeds to 748, described below.

At 742, the control unit 406 determines whether a request has been received from the user via the user interface 424 to edit the currently displayed pattern 105 (e.g., the scanned in pattern). If at 742, the control unit 406 determines that a request has not been made to edit the currently displayed pattern 105, then the control unit 406 proceeds to 748, described below. Otherwise, if at 742 the control unit 406 determines that a request has been made to edit the currently displayed pattern 105, then the control unit 406 proceeds to 745 where the control unit 406 receives edits to the pattern provided by the user via the user interface 424. The control unit 406 then proceeds to 748.

At 748, the control unit 406 determines whether a request to store the displayed pattern 105 has been received from the user via the user interface 424. If, at 748, the control unit 406 determines that a request to store the displayed pattern 105 was not received from the user via the user interface 424, then the control unit 406 halts operation in accordance with method 700 at 754. Otherwise, if at 748 the control unit 406 determines that a request to store the displayed pattern 105 was received from the user via the user interface 424, then the control unit 406 proceeds to 751 where the control unit 406 provides the displayed pattern data to the pattern storage unit 415 for storage. The control unit 406 then terminates operation in accordance with method 700 at 754.

Figure 8A:
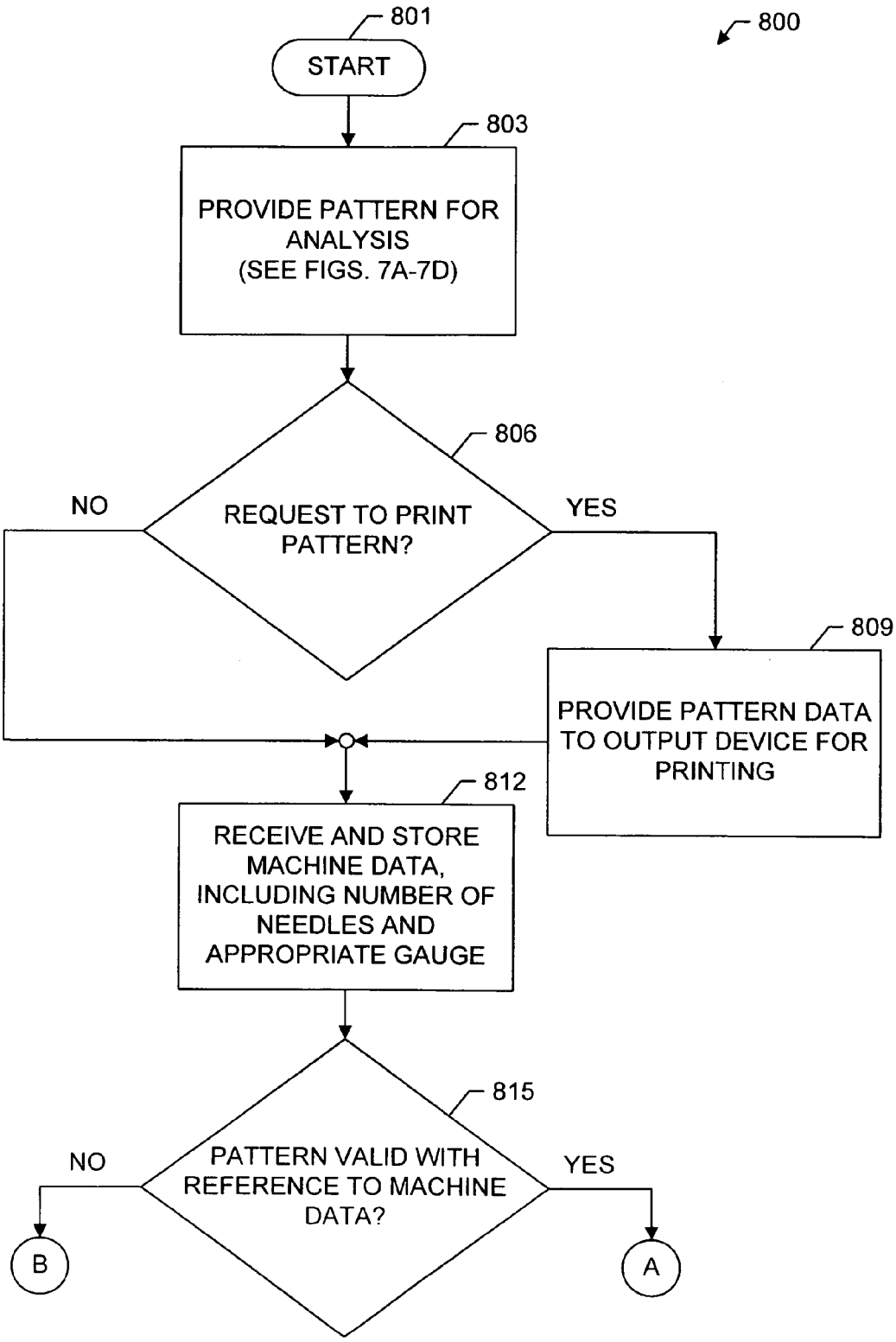
FIGS. 8A-8C display a flowchart representation of a method of creating a report including a chart indicating the colors of a pattern associated with needles of a tufting machine and a summary of the number of yarn cones needed by the machine for such pattern in accordance with an exemplary embodiment of the present invention.
Figure 8B:
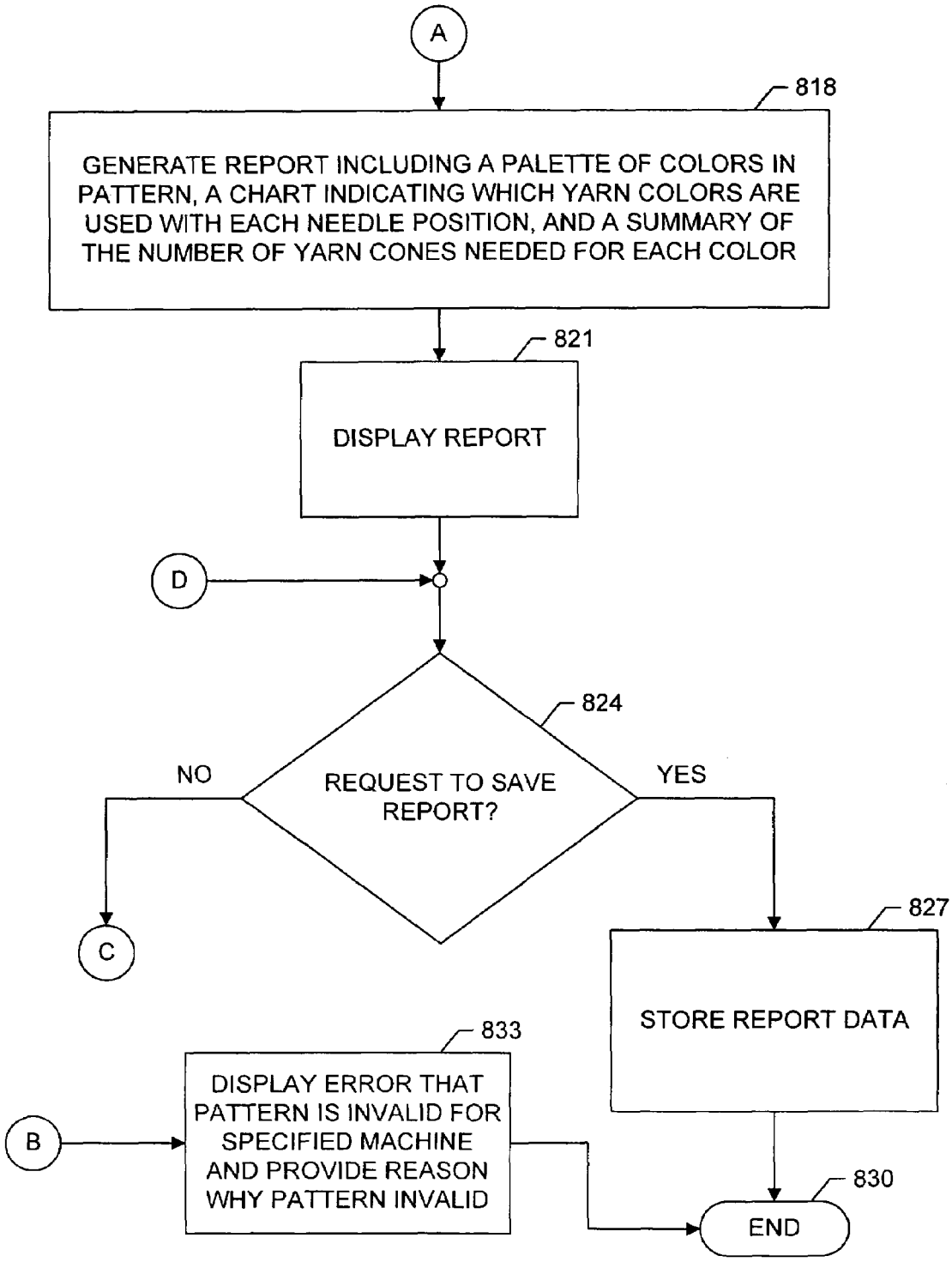
Figure 8C:
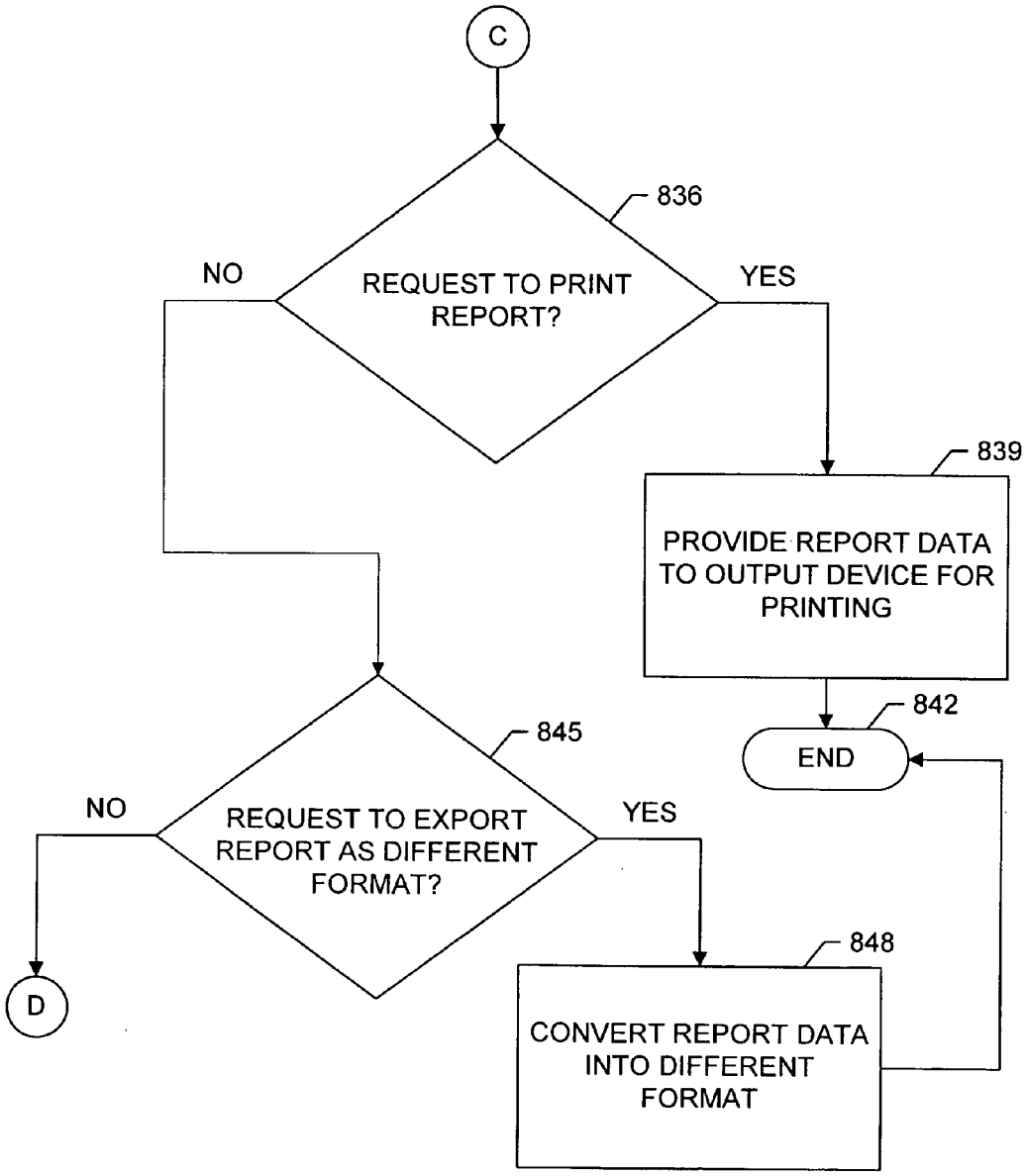

FIGS. 8A-8C display a flowchart representation of a method 800 of creating a report including a chart indicating the colors of a pattern 105 associated with needles of a tufting machine and a summary of the number of yarn cones needed by the machine for such pattern 105 in accordance with an exemplary embodiment of the present invention. Through the pattern analysis unit 409, the control unit 406 of the present invention may analyze a pattern 105 to determine its validity for a particular tufting machine, determine the colors represented in the pattern 105, assign a percentage of each color to a needle position of the tufting machine, and determine where to position each yarn color on the creels associated with each needle of the tufting machine. The data generated by the pattern analysis unit 409 may then be provided to the report generator unit 412 for the generation of a report that includes a color palette 203 of the pattern 105, a chart 301 indicating which yarn colors are used with each needle position of the tufting machine, and a summary of the number of yarn cones needed for each color.

After starting at 801, the control unit 406 proceeds to 803 where a pattern 105 is provided by the user (see FIGS. 7A-7D). Next, at 806, the control unit 406 determines whether a request to print the displayed pattern 105 has been received from the user via the user interface 424. If, at 806, the control unit 406 determines that a request to print the displayed pattern 105 has been received by the user via the user interface 424, then the control unit 406 proceeds to 809 where the control unit 406 provides the pattern data to an output device 536, such as a printing device 427, for printing. The control unit 406 then proceeds to 812, described below. Otherwise, if at 806 the control unit 406 determines that a request to print the displayed pattern 105 has not been received by the user via the user interface 424, then the control unit 406 proceeds to 812.

At 812, the control unit 406 receives machine data from the user via the user interface 424. As described above, machine data may include, but is not limited to, the number of needles of the particular tufting machine, the gauge of the tufting machine, and the width of the section or column tufted by each needle of the tufting machine. The control unit 406 provides the machine data to the machine data storage unit 418 for storage. The control unit 406 proceeds to 815 where the control unit 406 determines whether the provided pattern 105 is valid with reference to the tufting machine specified by the provided machine data. If, at 815, the control unit 406 determines that the provided pattern 105 is invalid, then the control unit 406 proceeds to 833 where the control unit 406 provides an error message to the user interface 424 that indicates that the provided pattern 105 is invalid and the reason why the pattern 105 is invalid. The control unit 406 then halts operation in accordance to method 800 at 830. If, however, at 815, the control unit 406 determines that the provided pattern 105 is valid, then the control unit 406 proceeds to 818 where the report generator unit 412 generates a report including a palette of colors in the provided pattern 105, a chart indicating which yarn colors are used with each needle position of the specified tufting machine, and a summary of the number of yarn cones needed for each color within the pattern 105. Next, at 821, the control unit 406 provides the report data to the user interface 424 for display. The control unit 406 then proceeds to 824 where the control unit 406 determines whether a request to store the report data was received from the user via the user interface 424. If, at 824, the control unit 406 determines that a request to store the report data was not received, then the control unit 406 proceeds to 836, described below. If, however, at 824, the control unit 406 determines that a request to store the report data was received, then the control unit 406 proceeds to 827 where the control unit 406 provides the report data to the report data storage unit 421 for storage. The control unit 406 then terminates operation in accordance with method 800 at 827.

At 836, the control unit 406 determines whether a request to print the report data has been received from the user via the user interface 424. If, at 836, the control unit 406 determines that a request to print the report data has not been received, then the control unit 406 proceeds to 845, described below. If, however, at 836, the control unit 406 determines that a request to print the report data has been received, then the control unit 406 proceeds to 839 where the control unit 406 provides the report data to an output device 536, such as printing device 427, for printing. The control unit 406 then halts operation in accordance with method 800 at 842.

At 845, the control unit 406 determines whether a request to export the report data to a different format has been received from the user via the user interface 424. If, at 845, the control unit 406 determines that a request to export the report data has not been received, then the control unit 406 proceeds to 824, described above. Otherwise, if at 845 the control unit 406 determines that a request to export the report data has been received, then the control unit 406 proceeds to 848 where the control unit 406 converts the report data to a different format, such as but not limited to, portable document format (PDF). The control unit 406 then terminates operation in accordance with method 800 at 842.

Figure 9A:
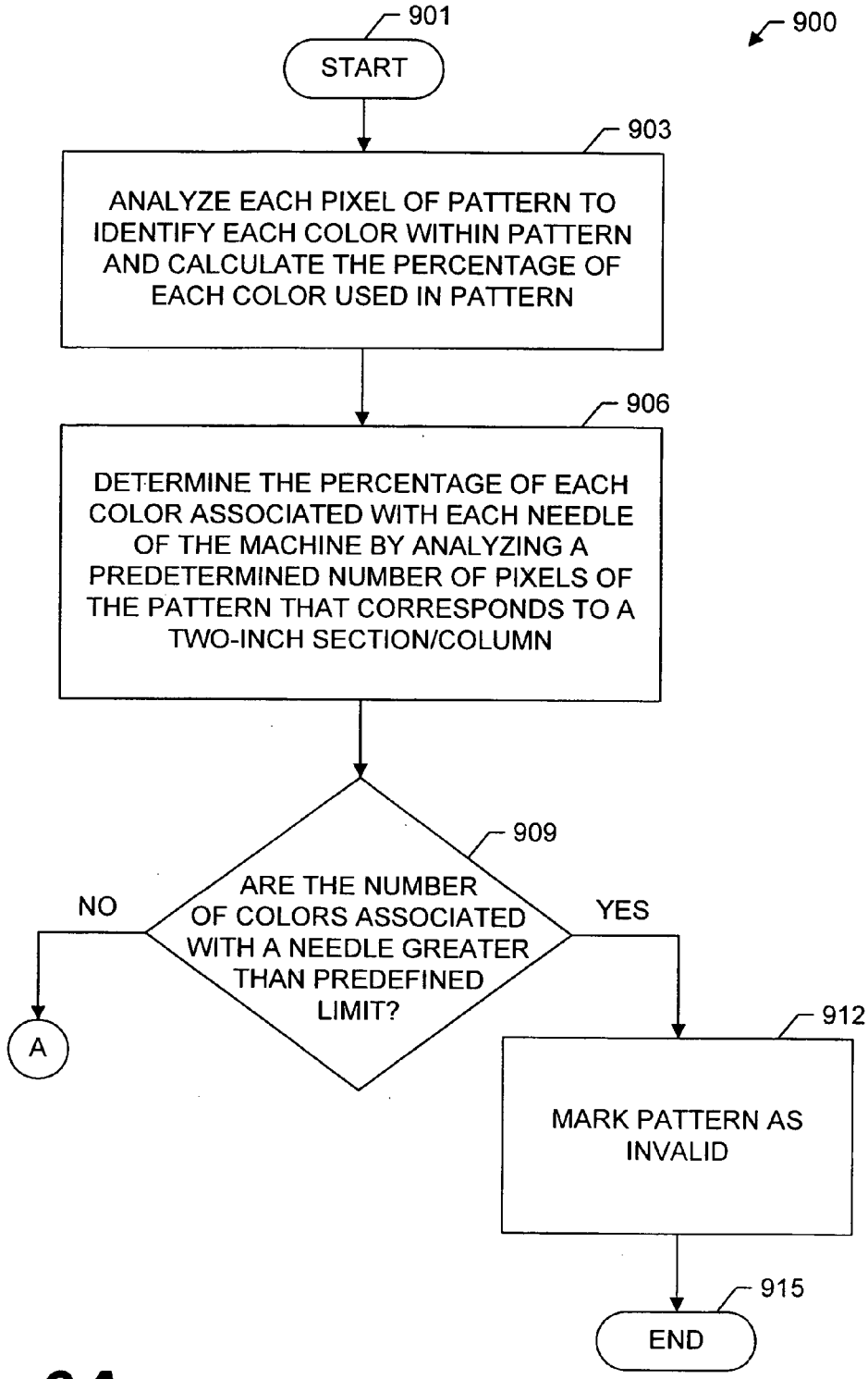
FIGS. 9A-9B display a flowchart representation of a method of validating a pattern for a predetermined machine and determining the number of yarn cones needed by the machine to implement such pattern in accordance with an exemplary embodiment of the present invention.
Figure 9B:
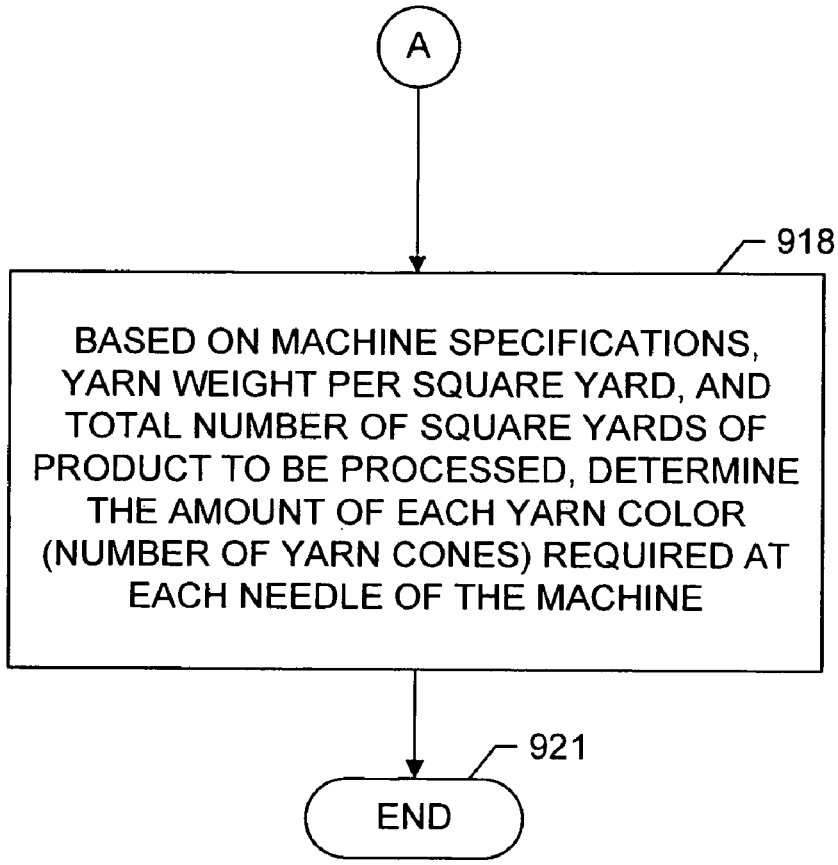

FIGS. 9A-9B display a flowchart representation of a method 900 of validating a pattern 105 for a predetermined machine and determining the number of yarn cones needed by the machine to implement such pattern 105 in accordance with an exemplary embodiment of the present invention. Validating a pattern 105, as referred to in FIGS. 8A-8C at 815, requires an analysis of each pixel within the pattern 105 to determine the number of colors used. More specifically, the pattern 105 may be divided into sections or columns of a predetermined pixel width, wherein each section or column represents the tufting area of a particular needle of the tufting machine. By analyzing each section or column, the percentage of color used for each needle position of the tufting machine may be determined.

After starting at 901, the control unit 406 proceeds to 903 where the pattern analysis unit 409 of the control unit 406 analyzes each pixel of the pattern 105 to identify each color within the pattern 105 and to determine the percentage of each color used within the pattern 105. Next, at 906, the pattern analysis unit 409 determines the percentage of each color associated with each needle position of the specified tufting machine by analyzing a predetermined number of pixels of the pattern 105 that corresponds to the predetermined section or column of the pattern 105. The predetermined section or column represents the amount of carpet that each needle tufts. For example and not limitation, a tufting machine with a 1/10 gauge (1/10 of an inch between needles) corresponds to a pattern 105 with ten pixels per inch. Accordingly, a two-inch wide section or column may correspond to a width of twenty pixels within the pattern 105. Therefore, under this example, the pattern analysis unit 409 may analyze a twenty pixel wide section or column of the pattern 105 for each needle of the tufting machine.

Next, at 909, the pattern analysis unit 409 determines whether the number of colors associated with each needle of the tufting machine (e.g., the number of colors found in the predetermined section or column) is greater than the predetermined limit. For example and not limitation, a tufting machine may have only six creels associated with each needle. Each creel holds one color of yarn (i.e., a yarn cone). Thus, a section or column comprising more than six colors would be invalid, because the tufting needle could not tuft the correct number of colors for the pattern 105. If, at 909, the pattern analysis unit 409 determines that the number of colors associated with a needle of the tufting machine is greater than the predefined limit, then the pattern analysis unit 409 proceeds to 912 where the pattern 105 is marked as invalid. The pattern analysis unit 409 then terminates operation in accordance with method 900 at 915. If, however, at 909, the pattern analysis unit 409 determines that the number of colors associated with the needles of the tufting machine is not greater than the predetermined limit, then the pattern analysis unit 409 proceeds to 918 where the pattern analysis unit 409 determines the amount of each yarn color (number of cones) required at each needle position of the machine. For example and not limitation, the pattern analysis unit 409 may use the machine parameters, yarn weight per square yard, and total number of square yards of product to be processed to determine the amount of each yarn color required at each needle position of the tufting machine. The pattern analysis unit 409 then halts operation in accordance with method 900 at 921.

Whereas the present invention has been described in detail it is understood that variations and modifications may be effected within the spirit and scope of the invention, as described herein before and as defined in the appended claims. The corresponding structures, materials, acts, and equivalents of all mean-plus-function elements, if any, in the claims below are intended to include any structure, material, or acts for performing the functions in combination with other claimed elements as specifically claimed.

What is claimed is:

1. A method of generating a report for a tufting machine, the method comprising:

receiving digital image data from a pattern storage unit, wherein the digital image data represents a pattern having multiple colors;

receiving operational characteristics of a tufting machine;

validating the pattern for the tufting machine, based on the operational characteristics;

generating a report designating at least one color of the pattern with at least one needle of the tufting machine, wherein the report includes yarn loading instructions of the tufting machine, such that when loaded the tufting machine can create a product having the pattern.

2. The method of claim 1, wherein generating a report with yarn loading instructions comprises:

determining at least one color of a portion of the pattern, wherein the portion of the pattern corresponds to at least one needle of the tufting machine; and designating the at least one color with the at least one needle of said tufting machine.

3. The method of claim 2, wherein determining at least one color comprises:

analyzing at least one pixel of the portion of the pattern; and identifying at least one color of the at least one pixel.

4. The method of claim 1, wherein the report further includes a color palette indicating a percentage of each color used within the pattern.

5. The method of claim 4, wherein generating a report having a color palette comprises:

determining at least one color of the pattern by analyzing at least one pixel of the pattern; and determining a percentage that the at least one color is used in the pattern.

6. The method of claim 1, wherein the report further includes a cone count summary indicating a number of yarn cones required for the at least one needle of the tufting machine.

7. The method of claim 1, wherein validating the pattern for the tufting machine comprises:

determining a number of colors of a portion of the pattern, wherein the portion of the pattern corresponds to at least one needle of the tufting machine;

determining whether the number of colors is greater than a predetermined number of colors associated with the at least one needle of the tufting machine, wherein the operational characteristics include the predetermined number of colors; and if the number of colors is greater than the predetermined number of colors, determining that the pattern may not be implemented on the tufting machine; and if the number of colors is not greater than the predetermined number of colors, determining that the pattern may be implemented on the tufting machine.

8. The method of claim 7, wherein determining a number of colors of a portion of the pattern comprises:

analyzing at least one pixel of the portion of the pattern; and enumerating at least one color of the at least one pixel.

9. A method of generating a report for a tufting machine, the method comprising:

receiving digital image data from an input device representing a pattern having a plurality of colors;

receiving operational characteristics of a tufting machine, wherein the operational characteristics include a number of needles of the tufting machine and a number of colors associated with each needle;

validating the pattern for the tufting machine, based on the operational characteristics;

generating a report via a report generator unit, wherein the report designates at least one color of the pattern with at least one needle of the tufting machine, wherein the report includes yarn loading instructions of the tufting machine, such that when loaded the tufting machine can create a product having the pattern.

10. The method of claim 9, wherein the report further includes a color palette indicating a percentage of each color used within the pattern, such that an amount of each corresponding color of yarn necessary to create the product having the pattern can be determined.

11. The method of claim 9, wherein the report further includes a cone count summary indicating a number of yarn cones required for the at least one needle of the tufting machine.

12. The method of claim 9, wherein validating the pattern for the tufting machine comprises:

determining a number of colors of a portion of the digital image data, wherein the portion of the digital image data corresponds to at least one needle of the tufting machine;

determining whether the number of colors of the portion is greater than the number of colors associated with each needle; and if the number of colors of the portion is greater than the number of colors associated with each needle, determining that the pattern may not be implemented on the tufting machine; and if the number of colors of the portion is not greater than the number of colors associated with each needle, determining that the pattern may be implemented on the tufting machine.

13. A computer-readable medium comprising computer-executable instructions for generating a report for a tufting machine, the computer-executable instructions comprising:

receiving digital image data from a pattern storage unit, wherein the digital image data represents a pattern having multiple colors;

receiving operational characteristics of a tufting machine;

validating the pattern for the tufting machine, based on the operational characteristics, comprising:

determining a number of colors of a portion of the pattern. wherein the portion of the pattern corresponds to at least one needle of the tufting machine;

determining whether the number of colors is greater than a predetermined number of colors associated with the at least one needle of the tufting machine, wherein the operational characteristics include the predetermined number of colors; and if the number of colors is greater than the predetermined number of colors, determining that the pattern may not be implemented on the tufting machine; and if the number of colors is not greater than the predetermined number of colors, determining that the pattern may be implemented on the tufting machine; and generating a report designating at least one color of the pattern with at least one needle of the tufting machine, wherein the report includes yarn loading instructions of the tufting machine, such that when loaded the tufting machine can create a product having the pattern.

14. The computer-readable medium of claim 13, wherein generating a report with yarn loading instructions comprises:

determining at least one color of a portion of the pattern, wherein the portion of the pattern corresponds to at least one needle of the tufting machine; and designating the at least one color with the at least one needle of said tufting machine.

15. The computer-readable medium of claim 14, wherein determining at least one color comprises:

analyzing at least one pixel of the portion of the pattern; and identifying at least one color of the at least one pixel.

16. The computer-readable medium of claim 13, wherein the report further includes a color palette indicating a percentage of each color used within the pattern.

17. The computer-readable medium of claim 16, wherein generating a report having a color palette comprises:

determining at least one color of the pattern by analyzing at least one pixel of the pattern; and determining a percentage that the at least one color is used in the pattern.

18. The computer-readable medium of claim 13, wherein the report further includes a cone count summary indicating a number of yarn cones required for the at least one needle of the tufting machine.

19. The computer-readable medium of claim 13, wherein determining a number of colors of a portion of the pattern comprises:

analyzing at least one pixel of the portion of the pattern; and enumerating at least one color of the at least one pixel.

* * * * *